US006026257A

United States Patent [19]

Takami et al.

[11] Patent Number: 6,026,257

[45] Date of Patent: Feb. 15, 2000

[54] IMAGE FORMING APPARATUS WITH CONSTANT CURRENT VOLTAGE CONTROL

[75] Inventors: Hiroshi Takami; Tatsuto Tachibana, both of Numazu, Japan

[73] Assignee: Canon Kabushiki Kaisha, Tokyo, Japan

[21] Appl. No.: 09/157,493

[22] Filed: Sep. 21, 1998

[30] Foreign Application Priority Data

Sep. 22, 1997 [JP] Japan ..... 9-275141

[51] Int. Cl.[7] ..... G03G 15/00; G03G 15/16

[52] U.S. Cl. ..... 399/66; 399/88

[58] Field of Search ..... 399/44, 66, 88, 399/313, 314

[56] References Cited

U.S. PATENT DOCUMENTS

| | | | |
|---|---|---|---|
| 5,172,138 | 12/1992 | Okazawa et al. | 346/134 |
| 5,179,397 | 1/1993 | Ohzeki et al. | 347/140 |
| 5,334,817 | 8/1994 | Nakamori et al. | 219/492 |
| 5,438,399 | 8/1995 | Asai | 399/314 |
| 5,450,180 | 9/1995 | Ohzeki et al. | 399/50 |
| 5,481,336 | 1/1996 | Tachibana et al. | 355/207 |
| 5,682,575 | 10/1997 | Komori | 399/66 |
| 5,713,060 | 1/1998 | Sato et al. | 399/20 |
| 5,815,782 | 9/1998 | Yokomori et al. | 399/285 |
| 5,819,134 | 10/1998 | Sato et al. | 399/69 |

FOREIGN PATENT DOCUMENTS 5-333722 12/1993 Japan .

*Primary Examiner*—Joan Pendegrass
*Attorney, Agent, or Firm*—Fitzpatrick, Cella, Harper & Scinto

[57] ABSTRACT

An image forming apparatus includes an image bearing member; a transfer member for transferring an image from the image bearing member onto a transfer material by a nip formed between the image bearing member and the transfer member; control means for effecting a constant current control for the transfer member with a predetermined current when a non-image area of the image bearing member is at the nip, and for effecting a constant voltage control for the transfer member during image transfer operation on the basis of a voltage applied to the transfer member during the constant current control; wherein a higher one of a constant voltage control signal for controlling the voltage in the constant voltage control and a constant current control signal for controlling the current in the constant current control, is selected as an output signal to the transfer member.

5 Claims, 7 Drawing Sheets

IMAGE FORMING APPARATUS WITH CONSTANT CURRENT VOLTAGE CONTROL

FIELD OF THE INVENTION AND RELATED ART

The present invention relates to an image forming apparatus of an image transfer type.

More specifically, the present invention relates to such an image forming apparatus of a transfer type that comprises an image bearing member, and an image transferring member which forms a transfer nip by being pressed upon the image bearing member. Through the transfer nip, recording medium is passed, and while the recording medium is passed through the transfer nip, transfer bias is applied to the image transferring member so that a transferable image formed on the image bearing member is transferred onto the recording medium.

An image forming apparatus of a transfer type has been widely used. In this type of image forming apparatus, a transferable image, which is usually a toner image, is formed on the peripheral surface of an image bearing member, such as an electrophotographic photosensitive member or an electrostatically recordable dielectric member, through an optional image forming process, in accordance with image formation data. Then, the transferable image is transferred onto a piece of recording medium, for example, a sheet of paper, and is permanently fixed to the recording medium. Thereafter, the recording medium is outputted as a copy or a print from the apparatus. The image bearing member is repeatedly used for image formation.

As for a means for transferring a toner image as the transferable image formed on an image bearing member such as an electrophotographic photosensitive member, a transferring means of the contact transfer type, which employs a contact type transferring member represented by a transfer roller, has been widely in use. This type of transferring member has merit in that it affords the capacity reduction of the power source, and also it produces a smaller amount of by-product, for example, ozone, related to electrical discharge, in comparison to a transferring member which employs a corona type charging device or the like.

A transfer roller as the contact type transferring member comprises, for example, a metallic core, and an elastic layer. The elastic layer is formed around the peripheral surface of the metallic core, and has an electrical resistance in a medium range. The transfer roller is directly pressed upon the image bearing member, with the application of a predetermined amount of pressure, so that a transfer station (transfer nip) is generated between the image bearing member and the transfer roller, with the presence of the elasticity of the elastic layer. The transfer roller is rotated in such a manner that in the transfer station, the peripheral surfaces of the transfer roller and the image bearing member move in the same direction, and also their peripheral velocity becomes substantially the same.

The recording medium delivered to the transfer station is conveyed through the transfer station, being pinched by the image bearing member and the transfer roller, and its image receiving surface being tightly in contact with the image bearing member. From the moment the leading edge of the recording medium arrives at the transfer station to the moment the following edge of the recording medium comes out of the transfer station, a predetermined transfer bias (transfer voltage) is applied to the metallic core of the transfer roller from a transfer bias applying means (transfer bias outputting apparatus, transfer voltage generation power source, or external power source).

While the recording medium is passed through the transfer station, being pinched by the transfer station, the toner image on the image bearing member is transferred from one end to the other, by the function of the transfer electric field and the pressure, which are generated by the transfer roller in the transfer station.

In a contact type charging system, the electrical resistance of a transfer roller as the contact type charging member changes its properties as environmental changes or the like occur. Therefore, generally speaking, certain measures are taken to properly control the transfer bias applied to the transfer roller, that is, to adjust the transfer bias in response to the changes in the properties of the transfer roller.

As for one such measure for controlling the voltage applied to a transfer roller, there is the so-called ATCC (Automatic Transfer Voltage Control).

According to the ATCC, a transfer bias applying means is controlled (constant current mode) so that the level of the current which flows through a transfer roller remains at a predetermined value $I_0$ during the period in which the image less portion of the peripheral surface of the image bearing member is in the transfer station (period in which recording medium is not in the transfer station). During this period, the value of the voltage Veto applied to the transfer roller is detected.

The transfer voltage $V_t$ is set according to the thus detected value of the voltage Veto. For example, the optimum transfer voltage $V_t$ is calculated using the following mathematical formula:

$$V_t = a \times Veto + b[IV].$$

Then, during the period in which the image bearing portion of the peripheral surface of the image bearing member is in the transfer station (when recording medium is in the transfer station), the transfer voltage $V_t$ with the thus calculated value is applied to the transfer roller, while keeping the transfer voltage $V_t$ constant, to transfer the toner image from the image bearing member to the recording medium (constant voltage mode).

When the transfer voltage is set using the above method, the transfer voltage applied to the transfer roller is properly controlled in response to the changes in the properties of the contact type charging member, and therefore, a transferable image can always be desirably transferred regardless of the changes in properties, for example, electrical resistance, of the transfer roller caused by the environmental changes or the like.

The aforementioned period in which the image less portion of the peripheral surface of the image bearing member is in the transfer station means the pre-rotation period of an image forming apparatus, i.e. The period from the moment at which the image forming apparatus begins to be driven in response to a print start signal, to the moment at which the leading edge of the first recording medium arrives at the transfer station (period in which no recording medium is being passed through the transfer station). In the case of a continuous printing mode, this period means the so-called "sheet interval", i.e. Ea period correspondent to the distance between the trailing edge of the preceding recording medium and the leading edge of the following recording medium, in which the portion of the image bearing member, in the transfer station, is the image less portion of the image bearing member (period in which no recording sheet is being passed through the transfer station).

The output of the transfer voltage generating section of the transfer bias applying means is controlled by two signals from the CPU which controls the electrical power source: a constant voltage output signal (CVD), and a constant current drive signal (CCD).

The constant voltage output signal (CVD) is an analog control signal for controlling the output level of the transfer voltage applying means in the constant voltage mode, and as the voltage of the signal is increased, the transfer voltage $V_t$ increases.

The constant current drive signal (CCD) is a signal for causing an electrical current of the predetermined value $I_0$ to flow through the transfer roller, and is used in the constant LOW current mode.

A voltage detection signal (VSEN) is an analog signal for detecting the output voltage of the power source, and the value of the voltage $V_{to}$ applied in the constant current mode is detected with the use of this signal.

FIG. 7 is a timing chart for the transfer bias applying means, and shows the points in time at which the constant voltage output signal (CVD), the constant current drive signal (CCD), and the transfer voltage $V_t$, are turned on or off when the operational mode of the transfer bias applying means is switched between the constant current mode and the constant voltage mode.

In the constant current mode, the ATCC is executed, with the constant voltage output signal (CVD) being set to zero, and then, the constant current drive signal (CCD) being turned on. In other words, in the constant current mode, the transfer bias applying means is controlled so that the current flowing through the transfer roller remains at the predetermined current level $I_0$, and the value of the level of the voltage $V_{to}$ applied in this mode is detected to determine (calculate) the value of the level of the transfer voltage $V_t$ to be applied for desirable image transfer.

The constant current mode is switched to the constant voltage mode by setting the constant current drive signal (CCD) at HIGH, in other words, turning off the constant current mode control, and then raising the voltage of the constant voltage output signal (CVD) to a predetermined level so that the transfer voltage $V_t$ is raised to the desirable voltage level, the value of which has been calculated in the aforementioned constant current mode.

In order to switch from this constant voltage mode to the constant current mode, first, the constant voltage output signal (CVD) is set to zero, and then, the constant current drive signal (CCD) is turned on. With these steps, the transfer bias applying means begins to be controlled again in such a manner that the current flowing through the transfer roller remains at the predetermined current level $I_0$. Then, the value of the level of the voltage $V_{to}$ applied during this period is detected, and the value of the desirable level of the transfer voltage $V_t$ to be applied in the following constant voltage mode is set (calculated) on the basis of the thus calculated value of the desirable level of the voltage $V_{to}$.

However, an image forming apparatus employing the conventional contact type transfer system and ATCC system suffers from the following problems.

The first problem: it takes a relatively long time t (output mode switching time) to switch the output mode of a transfer bias applying conventional means from the constant voltage mode to the constant current mode, because when a bias applying conventional means (transfer voltage outputting apparatus) is switched from the constant voltage mode to the constant current mode, first, the constant voltage output signal (CVD) must be set to zero, and then, the constant current drive (CCD) must be turned on.

Therefore, if the aforementioned output mode switching time t is longer than the length of the period in which the transfer bias applying means is driven in the constant current mode to execute the ATCC (to detect the value of the level of the voltage $V_{to}$ applied in the constant current mode, and to set the level of the transfer voltage $V_t$ to the proper value calculated based on the detected value of the voltage $V_{to}$, i.e. The length of the period in which the image less portion of the image bearing member is in the transfer station, or if the time allowed for the constant output in the constant current mode after the elapsing of the aforementioned output mode switching time t, during the period in which the image less portion of the peripheral surface of the image bearing member is in the transfer station, is not long enough for accurately carrying out the ATVC, the value of the level of the voltage $V_{to}$ applied in the constant current mode cannot be accurately detected, preventing the transfer bias applying means from outputting a transfer voltage $V_t$ of a proper level during the following constant voltage mode.

In particular, when an image forming apparatus is in the continuous printing mode in which recording sheets are continuously fed, and the ATVC is executed while driving the image forming apparatus in the constant current mode, during a so-called "sheet interval", which is the interval between the trailing edge of the preceding recording medium and the leading edge of the following recording medium, in other words, when the image less portion of the peripheral surface of the image bearing member is in the transfer station, the "sheet interval", i.e. The period in which the image less portion of the peripheral surface of the image bearing member is in the transfer station, becomes shorter in proportion to the image forming apparatus speed.

As a means for solving this problem, it is possible to consider increasing the distance between the preceding and following sheets so that the length of the period in which the image less portion of the peripheral surface of the image bearing member is in the transfer station increases. However, this method reduces the throughput of the image forming apparatus, that is, the performance of the apparatus is reduced, and therefore, cannot be said to be an effective means.

The second problem: when a transfer bias applying conventional means is controlled so that it outputs a voltage of an extremely low level, it cannot output a voltage of an accurate level. This is due to the following reasons: if the transfer voltage applying means is controlled so that it outputs a voltage of an extremely low level, 1. The value of the voltage level inputted to the operational amplifier in the transfer voltage applying means falls outside the reliable operational range, and therefore, the operation of the operational amplifier becomes abnormal;
2. The accuracy with which the value of the level of the output voltage of the transformer is detected deteriorates; and
3. The responsiveness of the control circuit changes, causing the output voltage to oscillate.

This problem occurs when the resistance value of a transfer roller is low, and the transfer voltage applying means is driven in the constant current mode.

SUMMARY OF THE INVENTION

An object of the present invention is to provide an image forming apparatus which requires a relatively short length of time to execute the constant current control over the transfer voltage applying means.

Another object of the present invention is to provide an image forming apparatus which is capable of quickly switching the the transfer voltage applying means control mode from the constant voltage control mode to the constant current control mode.

Another object of the present invention is to provide an image forming apparatus which is capable of executing the constant current control of the transfer voltage applying means, without reducing the throughput of the image forming apparatus.

Another object of the present invention is to provide an image forming apparatus which, during a continuous image forming operation in which an image is successively formed on a plurality of transfer medium, executes the constant current control of the transfer voltage applying means, from the moment the trailing edge of the preceding transfer medium comes out of the transfer station to the moment the leading edge of the following transfer medium, but executes the constant voltage control of the transfer voltage applying means while an image is transferred.

Another object of the present invention is to provide an image forming apparatus, the transfer voltage applying means of which can output correct transfer voltage even when the transfer voltage applying means is controlled in such a manner that the voltage outputted to the transferring member becomes low.

Another object of the present invention is to provide an image forming apparatus capable of reliably executing the constant current control of the transfer voltage applying means, even if the resistance value of the transferring member is extremely low, so that the transfer voltage applying means can output correct voltage to the transferring member.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
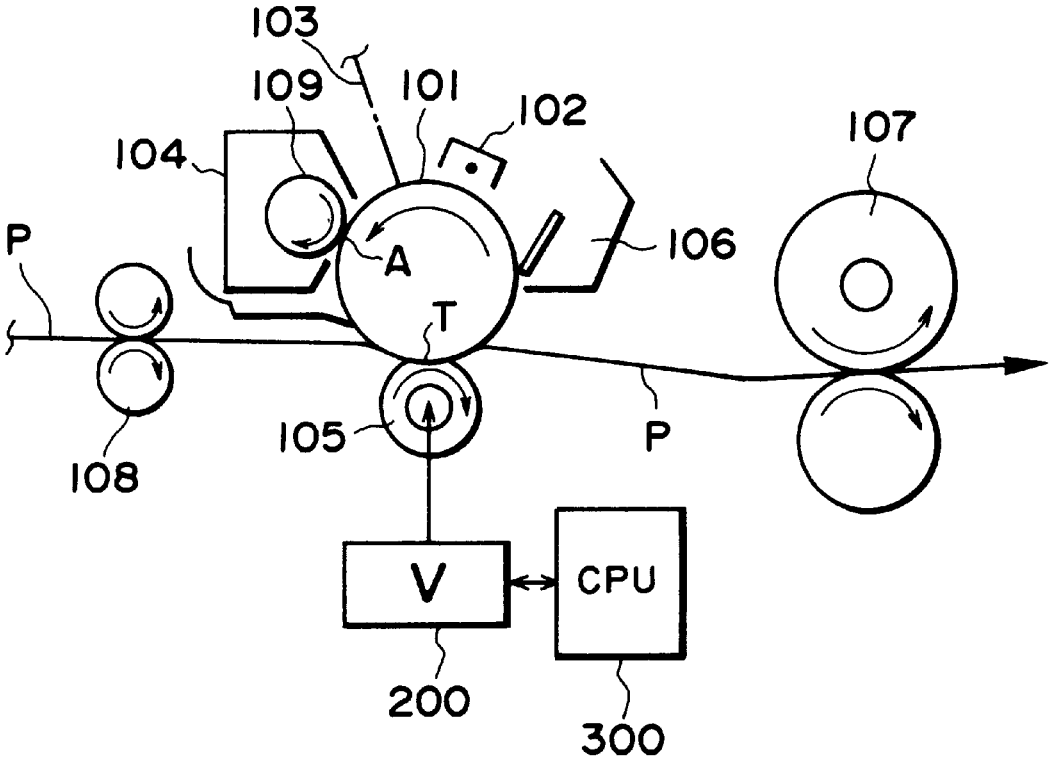
FIG. 1 is a schematic section of an image forming apparatus employing a contact type transfer method and the ATVC, in the first embodiment of the present invention. It depicts the general structure of the apparatus.
Figure 2:
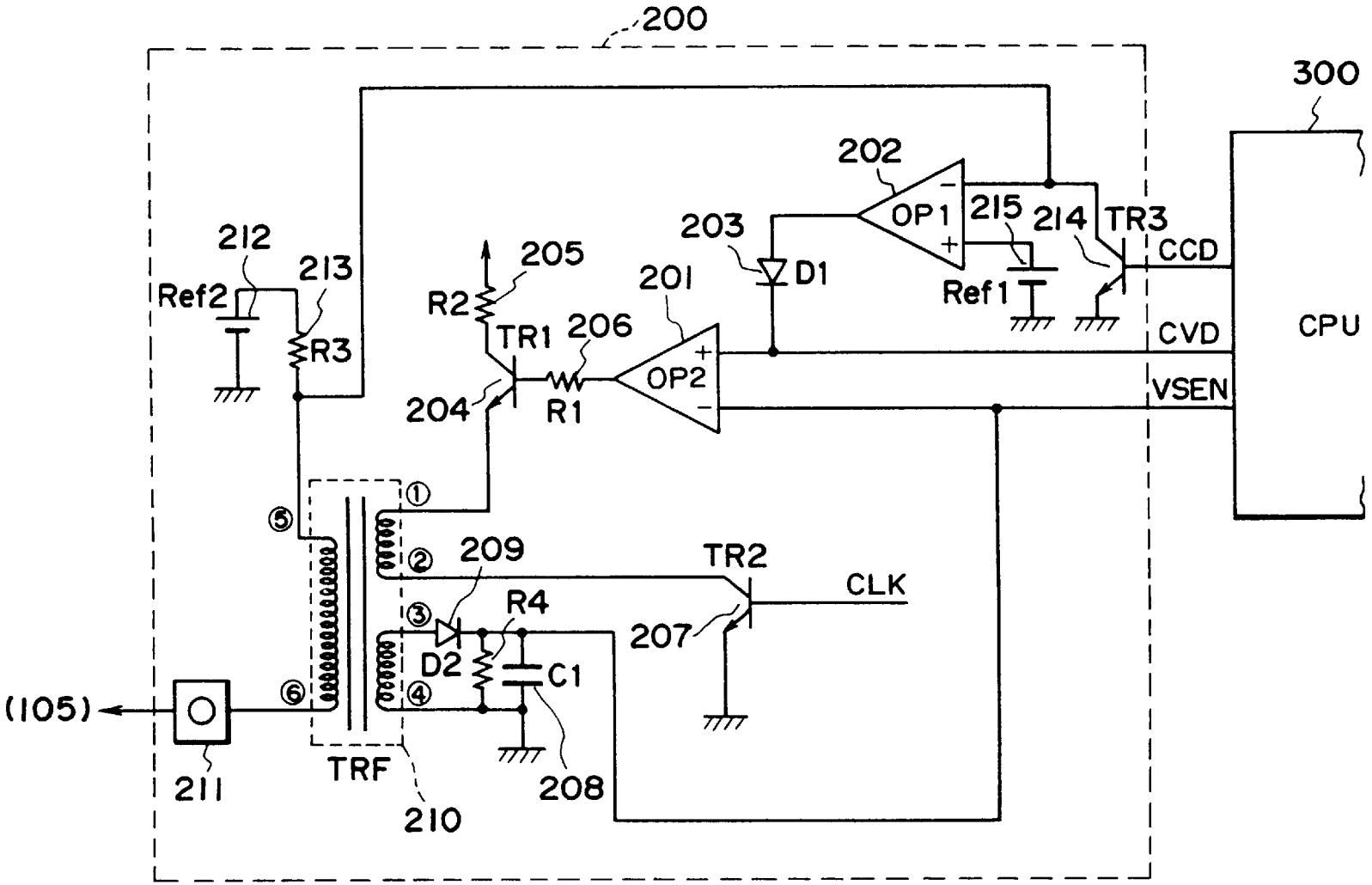
FIG. 2 is the circuit diagram of the transfer voltage outputting apparatus.
Figure 3:
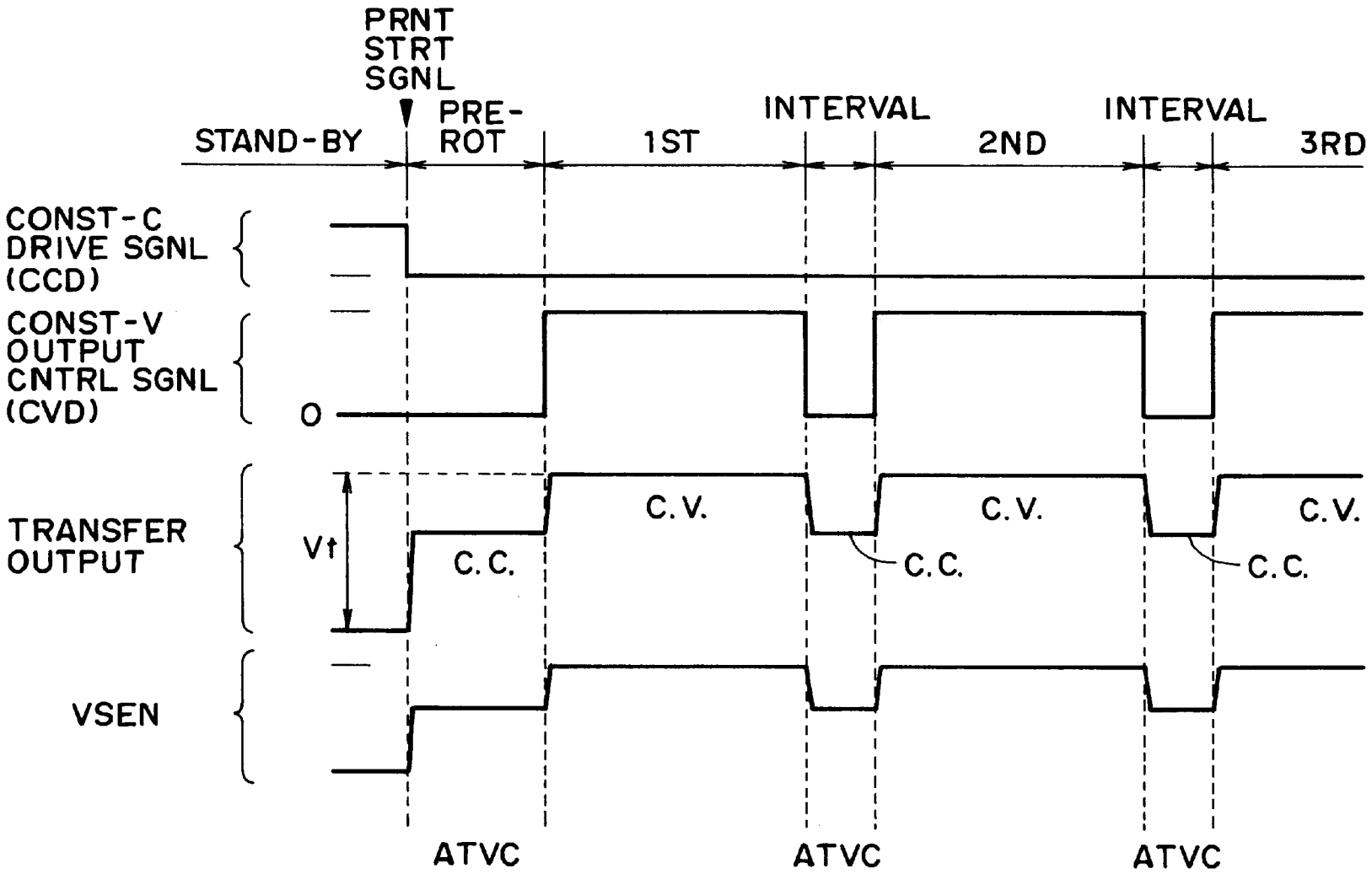
FIG. 3 is a timing chart for a method for driving the transfer voltage outputting apparatus.

Embodiment 1 (FIGS. 1–3)

FIG. 1 is a schematic section of the image forming apparatus employing a contact type charging system and the automatic transfer voltage control system, in this embodiment. The image forming apparatus in this embodiment is a copying machine or a printer, which employs a transfer type electrophotographic process.

1. General Structure of Image Forming Apparatus

A referential FIG. 101 designates an electrophotographic photosensitive member in the form of a rotative drum (image bearing first member to be called "photosensitive drum" hereinafter), which is rotative driven in the counterclockwise direction indicated by an arrow mark at a predetermined peripheral velocity (process speed). On this rotative photosensitive member, an image forming cycle comprising a charging process, an exposing process, a transferring process, and a cleaning process is carried out.

More specifically, the peripheral surface of the photosensitive drum 101, which is being rotative driven, is uniformly charged to predetermined polarity and potential level by a primary charging device 102.

Next, the uniformly charged peripheral surface of the photosensitive drum 101 is exposed to the light from an unillustrated exposing means (apparatus for projecting the image of a target image, apparatus for projecting a scanning laser beam modulated with image formation data, or the like). As the peripheral surface of the photosensitive drum 101 is exposed, electrical potential attenuates on its regions which are exposed to the light, and as a result, an electrostatic latent image reflecting the image formation data is formed on the peripheral surface of the photosensitive drum 101.

The electrostatic latent image is developed, starting from one end and progressing toward the other, into a transferable, visible toner image, by a developing apparatus 404, at the developing station A.

The toner image is transferred onto a sheet of recording paper P as a recording medium (image bearing second member), by a transferring means in the transfer station T.

The transferring means in this embodiment is such a transferring means that employs a contact type transferring member 105 in the form of a roller (hereinafter, "transfer roller"), and a contact type transfer system.

The transfer roller 105 comprises a metallic core, and an elastic layer formed on the peripheral surface of the metallic core. The elastic layer has its electrical resistance in an intermediate range. The transfer roller 105 is pressed upon the photosensitive drum 101 with a predetermined contact pressure, so that the transfer station T (transfer nip, i.e. The compression nip between the photosensitive drum 101 and the transfer roller 105) is formed at the interface between the peripheral surfaces of the photosensitive drum 101 and the transfer roller 105 due to the elasticity of the elastic layer of the transfer roller 105. The transfer roller 105 is rotated in such a manner that the peripheral surfaces of the photosensitive drum 101 and the transfer roller 105 move in the same direction at approximately the same velocity, in the transfer station T.

The recording sheet P is fed from an unillustrated feeding means, and is delivered to the transfer station T with an exact timing by a registration roller 108 disposed on the upstream side of the transfer station T in terms of the sheet delivery direction.

More specifically, the registration roller 108 delivers the recording sheet P to the transfer station T with such a timing that exactly the moment the leading end of the toner image formed on the peripheral surface of the photosensitive drum 101 arrives at the transfer station T, the leading edge of the recording sheet P arrives at the transfer station T.

After being delivered to the transfer station T, the recording sheet P is conveyed through the transfer station T, being pinched by the transfer roller 105 and the photosensitive drum 101 so that the surface of the recording sheet P remains tightly in contact with the peripheral surface of the photosensitive drum 101. From the moment the leading edge of the recording sheet P arrives at the transfer station T until the trailing edge of the recording sheet P comes out of the transfer station T, a predetermined transfer voltage, the level of which is automatically controlled, is applied to the metallic core of the transfer roller 105 from a transfer voltage outputting apparatus 200 as the transfer bias applying means controlled by a CPU 300.

The structure of this transfer voltage outputting apparatus 200, and the method for automatically controlling the output of this apparatus 200, will be described in detail in Section 2.

As the recording sheet P is conveyed through the transfer station T, being pinched by the transfer roller 105 and the photosensitive drum 101, the toner image on the rotating photosensitive drum 101 is transferred onto the recording sheet P, by the function of the electric field which the transfer roller 105 generates, and also by the function of the compressive force which the transfer station T generates, starting from the leading end and progressing toward the trailing end.

Then, as the recording sheet P comes out of the transfer station T, the recording sheet P separates from the peripheral surface of the rotating photosensitive drum 101, and is conveyed to a fixing apparatus 107, in which the toner image having been transferred onto the recording sheet P is fixed, as a permanent image, to the surface of the recording sheet P. Thereafter, the recording sheet P is discharged, as a copy or a print, from the image forming apparatus.

After the separation of the recording sheet P, the peripheral surface of the photosensitive drum 101 is cleaned by a cleaning apparatus 106; the contaminants such as the residual toner particles or paper dust adhering to the peripheral surface of the photosensitive drum 101 are removed by the cleaning apparatus 106. Then, the photosensitive drum 101 is used for the following image formation cycle.

There are various image forming processes; for example, a normal development process (background exposing process) and a reversal development process. According to the normal development process, the uniformly charged peripheral surface of the photosensitive drum 101 is exposed in accordance with the background portions of the image formation data, and the regions other than the regions correspondent to the background portions are developed, whereas according to the reversal development process, the uniformly charged peripheral surface of the photosensitive drum 101 is exposed in accordance with the image portion of the image formation data (image exposing process), and the unexposed regions are developed. These image forming processes are employed based on their characteristics.

In the image forming apparatus in this embodiment, the polarity to which the photosensitive drum 101 as the image bearing member is charged by the primary charging device 11 is negative, for example. The electrostatic latent image formed on the peripheral surface of the photosensitive drum 101 is developed into a toner image by a developing apparatus 104, through a reversal development system, which uses such toner (negative toner) that is charged to the negative polarity, that is, the same polarity as the polarity to which the photosensitive drum 101 is charged. More specifically, the toner is coated in a thin layer on the peripheral surface of the developing sleeve 109 rotative attached to the developing apparatus 104, and then, as a predetermined development bias is applied to the developing sleeve 109 from an unillustrated external power source (development voltage application power source), the toner on the developing sleeve 109 is transferred onto the photosensitive drum 101 in a manner to reflect the electrostatic latent image on the peripheral surface of the photosensitive drum 101. In other words, the electrostatic latent image is developed in reverse.

2. Structure of Transfer Voltage Outputting Apparatus 200 and Method for Automatically Controlling Transfer Voltage a. Transfer Voltage Outputting Apparatus 200

FIG. 2 shows the circuit structure of the transfer voltage outputting apparatus 200 as the transfer voltage applying means in this embodiment.

Transfer voltage is controlled by the constant voltage output controlling signal (CVD), and a constant current drive signal (CCD). The constant current drive signal is a constant current controlling signal. These signals are outputted from an external CPU 300 which controls the transfer voltage outputting apparatus 200, and the transfer voltage is controlled by this external CPU 300.

The constant voltage output control signal (CVD) is an analog control signal which keeps the transfer voltage level constant. More specifically, as the voltage level of this signal is increased, the output of the operational amplifier 201 increases, turning on a transistor 204, which in turn causes electrical current to flow through the wire wound on the primary side (between points 1 and 2) of a transformer 210. As a result, high voltage is generated in the wire wound on the secondary side (between points 5 and 6) of the transformer 210; the voltage at a transfer voltage output terminal 211 increases.

Further, the transformer 210 is provided with the wire wound on the primary side (between points 3 and 4) for detecting the level of the output voltage of the transformer 210. In this wound wire, voltage proportional to the voltage generated in the wound wire on the secondary side is generated. The voltage generated in this wound wire, i.e. The voltage for detecting the level of the output voltage on the secondary side, is rectified by a diode 209, a condenser 208, and a resistor Rd., and is applied to the negative side of the operational amplifier 201. With this structural arrangement, the transfer voltage stabilizes at a level proportional to the level of the constant voltage output control signal (CVD); in other words, the output voltage of the transfer voltage applying means is kept constant.

On the other hand, the constant current drive signal (CCD) is a control signal for driving the transfer voltage applying means in such a manner that constant current of a predetermined level flows through the transfer roller 105.

As the constant current drive signal (CCD) is turned off, the transistor 214 is turned off. As a result, a reference voltage Ref is applied to the positive side of the operational amplifier 202, increasing the output voltage of the operational amplifier 202, which in turn increases the voltage on the positive side of the operational amplifier 201. Consequently, the voltage level at the transfer voltage output terminal 211 increases as it does when the transfer voltage applying means is driven in the constant voltage mode. Meanwhile, as the output voltage of the transformer 210, i.e. The transfer voltage, rises, the transfer current flowing from the transfer voltage output also increases, causing the voltage to drop at both ends of a resistor 213. As a result, the voltage applied to the negative side of the operational amplifier 202 is reduced.

With the above structural arrangement, the transfer current $I_t$, caused to flow by the transfer voltage, stabilizes at the level, the value of which is defined by the following formula; in other words, the transfer voltage applying means is controlled in the constant current mode.

$$I_t=(Ref2-Ref1)/R3.$$

At this time, the role of the diode 203 will be described.

The diode 203 compares the level of the voltage output of the operational amplifier 202 which drives the transfer voltage applying means in the constant current mode, with the voltage level of the constant voltage output control signal (CVD), and sends the signal with the higher voltage level to the positive side of the operational amplifier 201 which directly controls the transformer 210. For example, when the voltage level of the constant voltage output control signal (CVD) is higher than the voltage level of the output of the operational amplifier 202, the constant voltage output control signal (CVD) is inputted into the operational amplifier 201 to keep constant the voltage output of the transfer voltage applying means, whereas when the voltage level of the output of the operational amplifier 202 is higher than that of the constant voltage output control signal (CVD), the output of the operational amplifier 202 is inputted into the operational amplifier 201 to keep constant the current flowing through the transfer roller 105.

b. Method for Controlling Transfer Voltage Outputting Apparatus 200, in ATVC mode.

Next, referring to the timing chart in FIG. 3, a method for controlling the transfer voltage outputting apparatus 200 in this embodiment, in the automatic transfer voltage control mode.

As a print start signal is inputted into the image forming apparatus on standby, a predetermined preparatory operation, inclusive of the pre-rotation of the photosensitive drum 101, i.e. The operation prior to the starting of an actual printing cycle, is carried out. As the predetermined preparatory operation ends, an actual printing operation begins. If the apparatus is in a continuous printing mode in which a predetermined number of recording sheets is continuously fed into the apparatus, the predetermined number of recording sheets are continuously fed into the transfer station T, with a predetermined "sheet interval" between the preceding and following recording sheets P, and a printing cycle is repeated for the first, second, third, and so on; the printing cycle is repeated for the same number of times as the number of the recording sheets P. As the printing on the last recording sheets ends, a predetermined process, inclusive of the post-rotation of the photosensitive drum 101, i.e. The preparatory operation for ending the image formation cycle of the apparatus, is carried out. After the end of the predetermined number of the post-rotations of the photosensitive drum 101, the rotational driving of the photosensitive drum 101 is stopped, and the apparatus is kept on standby again until the another print start signal is inputted.

When the apparatus is in a single print mode, the photosensitive drum 101 is rotated for a predetermined number of times after the end of the printing of a single print, and thereafter, the apparatus is kept on standby again until a print start signal is inputted again.

In this embodiment, the automatic transfer voltage control is executed during the pre-rotational period from the inputting of a print start signal to the beginning of the printing of the first print. It is also executed during the "sheet interval" if the apparatus is in the continuous print mode in which a predetermined number of recording sheets P is continuously fed.

More specifically, during the pre-rotational period, the constant current drive signal (CCD) is kept on, that is, kept at the LOW level, until the first recording sheet P arrives at the transfer station T, whereby the transfer voltage is driven by constant current. With this arrangement in place, the CPU 300 reads a voltage detection signal VEIN, and sets the level of the transfer voltage $V_t$ based on the level of the voltage $V_{to}$ of this voltage detection signal VEIN, ending the ATVC.

While a toner image is transferred onto the first recording sheet P, the constant current drive signal (CCD) is kept on, and the constant voltage output control signal (CVD) is increased to a predetermined level. During this period, the voltage of the constant voltage output control signal (CVD) is set at the level higher than the level of the output voltage of the operational amplifier 202 which becomes active in the constant current driving mode, and the diode 203 is turned off. As a result, the constant voltage output control signal (CVD) is inputted into the operational amplifier 201, causing the output voltage $V_t$ of the transfer voltage applying means to rise to the constant level of a proper value. In other words, in the case of the first recording sheet P, a toner image is transferred in the constant voltage mode regardless of the electrical resistance of the transfer roller 105.

At the end of the transferring of a toner image onto the first recording sheet P, the constant voltage output control signal (CVD) is lowered to zero, and the control mode is switched from the constant voltage mode to the constant current mode so that the automatic transfer voltage control is executed during the period correspondent to the sheet interval between the first and second recording sheets P. Then, a toner image is transferred onto the second recording sheet P in the constant voltage mode, that is, by the transfer voltage $V_t$, the value of which is set through the automatic transfer voltage control process.

As for the transferring of a toner image onto the third recording sheet P, fourth recording sheet P, and so on, a toner image is transferred in the constant voltage mode, in which the level of the transfer voltage $V_t$ is set through the automatic transfer voltage control executed during the sheet interval between the preceding recording sheet P and the current recording sheet P.

When the automatic transfer voltage control is executed in the above described manner, the time necessary for switching the control mode of the transfer voltage outputting apparatus 200 from the constant voltage mode to the constant current mode is reduced; the automatic transfer voltage control can be satisfactorily executed even during the "sheet interval" period which is shorter than the pre-rotation period.

Embodiment 2

In the first embodiment described above, the transfer voltage applying means is driven in the constant current mode by lowering the constant voltage output control signal (CVD) to zero, and turning on the diode 23. This embodiment is characterized in that in the constant current mode, the constant voltage output control signal (CVD) is set to such a level that. Outputs a transfer voltage of a predetermined low level.

The difference between this embodiment and the first embodiment will be described with reference to the timing charts in FIGS. 4 and 5. The first embodiment is different from the second embodiment in that in this embodiment, in the constant current mode, the voltage level of the constant voltage output control signal (CVD) is set to a predetermined level $\alpha$.

Figure 4:
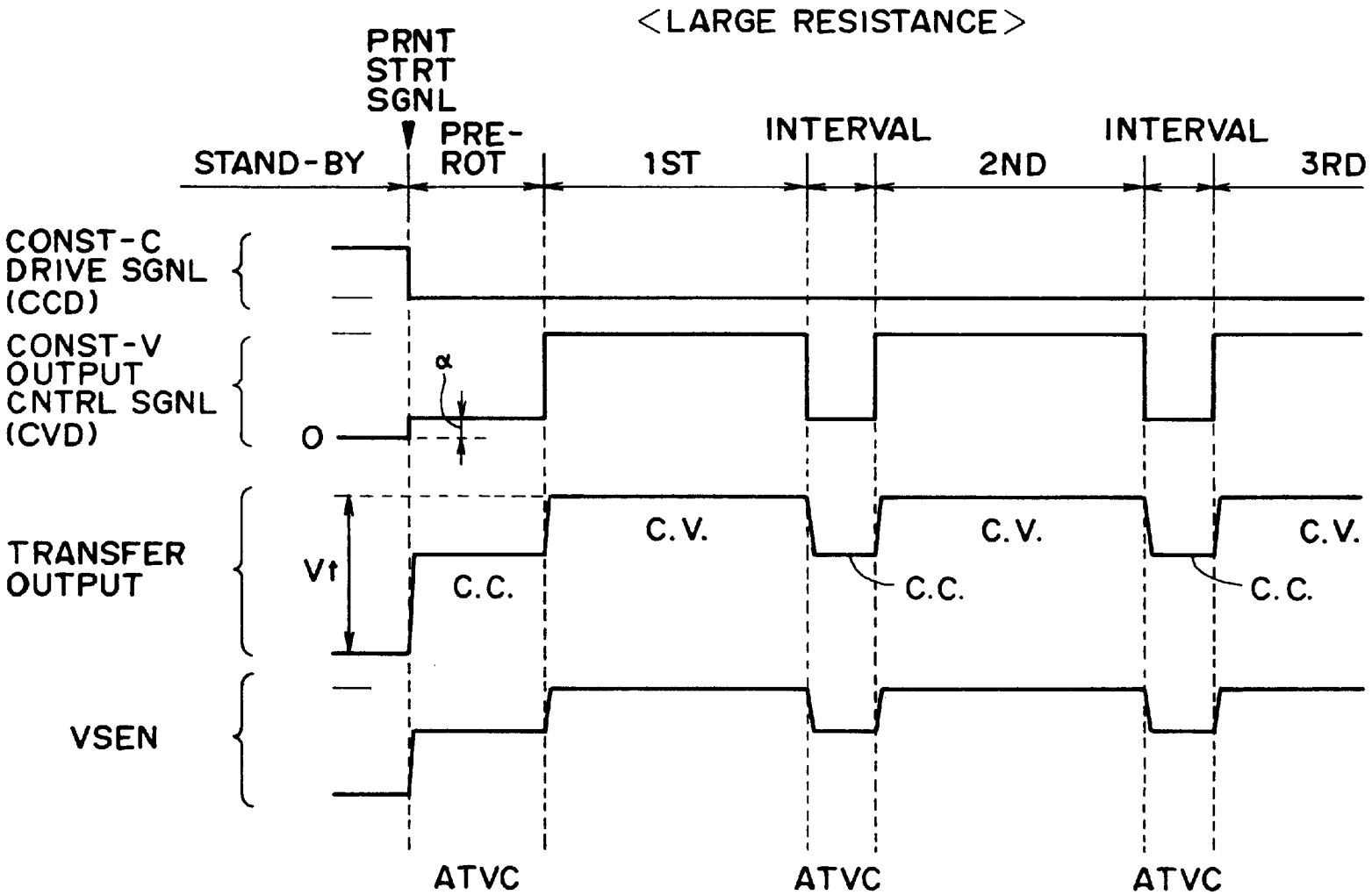
FIG. 4 is a timing chart for a method for driving the transfer voltage outputting apparatus in the image forming apparatus in the second embodiment of the present invention (case in which resistance value of transfer roller is relatively large)

FIG. 4 is a timing chart to be used when the resistance value of the transfer roller 105 is large. In this case, when the transfer voltage outputting means is driven in the constant current mode, constant current flows through the transfer roller 105, and the transfer voltage is generated, being applied to the transfer roller 105.

Figure 5:
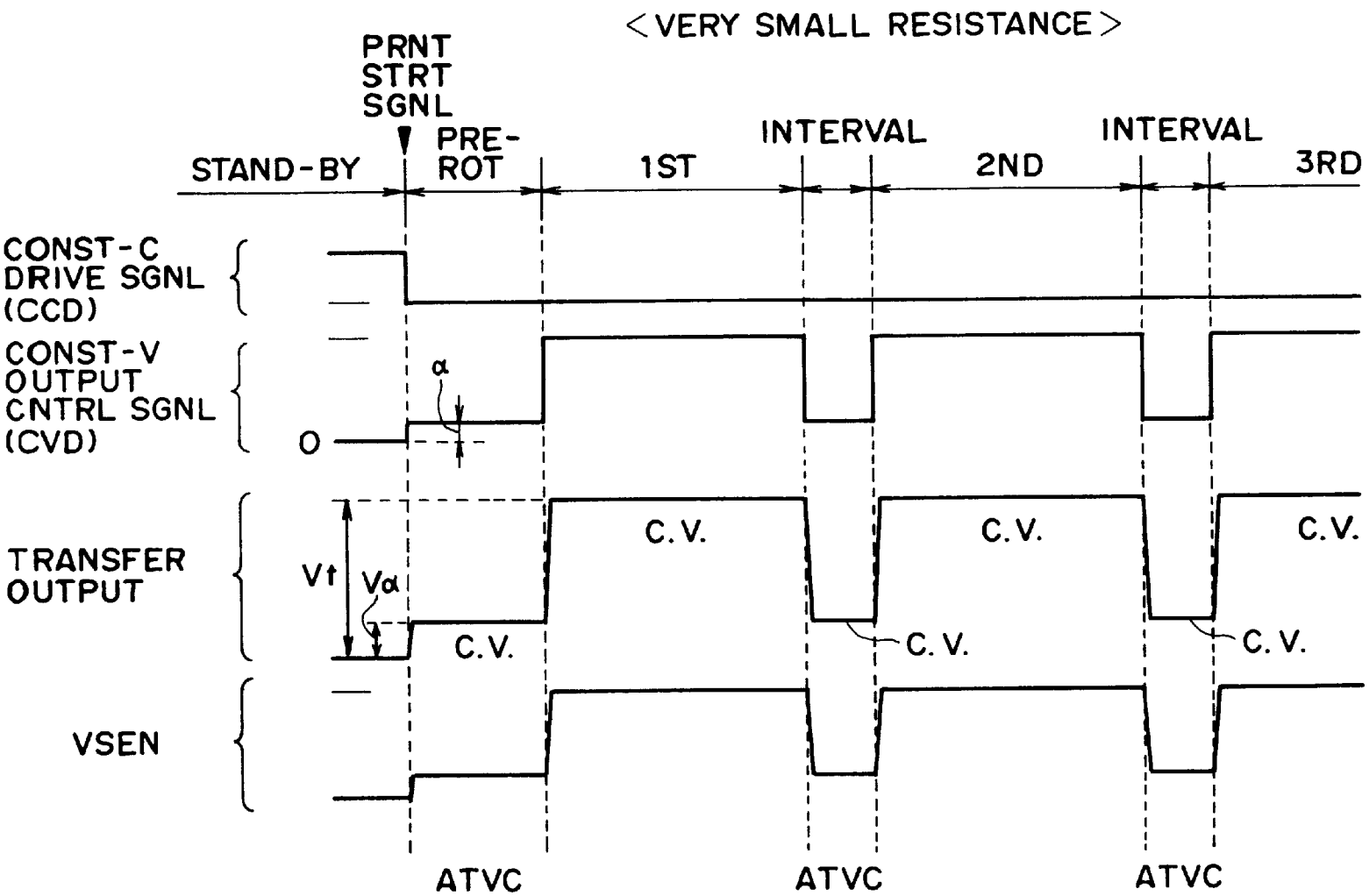
FIG. 5 is a timing chart for a method for driving the transfer voltage outputting apparatus in the image forming apparatus in the second embodiment of the present invention (case in which resistance value of transfer roller is extremely small).

FIG. 5 is a timing chart used when the resistance value of the transfer roller 105 is extremely small. In this case, constant current does not flow through the transfer roller 105 even in the constant current mode, and constant voltage Vα correspondent to the voltage value α of the level of the constant voltage output control signal (CVD) is outputted. This is due to the fact that the resistance value of the transfer roller 105 is extremely small, and therefore, the value of the level of the output voltage of the operational amplifier 202 becomes lower than the value a of the level of the constant voltage output control signal (CVD), failing to turning on the diode 203. As a result, the transfer voltage applying means is driven in the constant voltage mode. In other words, the voltage level of the constant voltage output control signal (CVD) becomes higher than that of the constant current drive signal (CCD).

When control is executed in the above described manner, the lower limit of the output voltage of the transfer voltage applying means is set to the predetermined voltage level with a value of Vα regardless of the resistance value of the transfer roller 105. As a result, it is possible to prevent the occurrence of such problems as the value of the level of the voltage inputted into the operational amplifier of the transfer voltage outputting apparatus 200 falling outside the voltage range in which the operational amplifier can reliably function, causing the operational amplifier to malfunction, accuracy in detecting the level of the output voltage of the transformer 210 deteriorating, and the responsiveness of the control circuit changing, causing the output voltage to oscillate.

Figure 6:
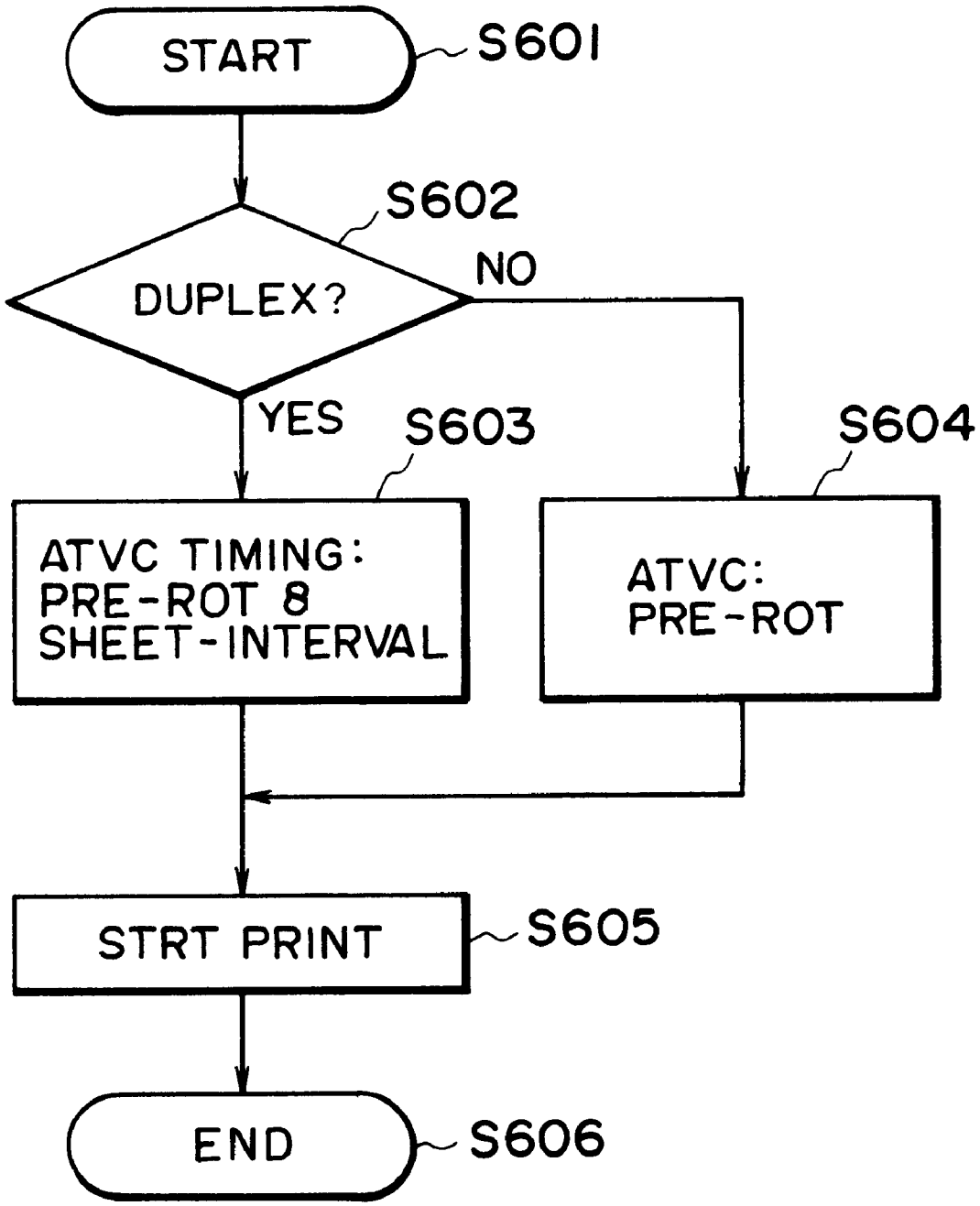
FIG. 6 is a flow chart which shows the operational sequence of the image forming apparatus in the third embodiment of the present invention.
Figure 7:
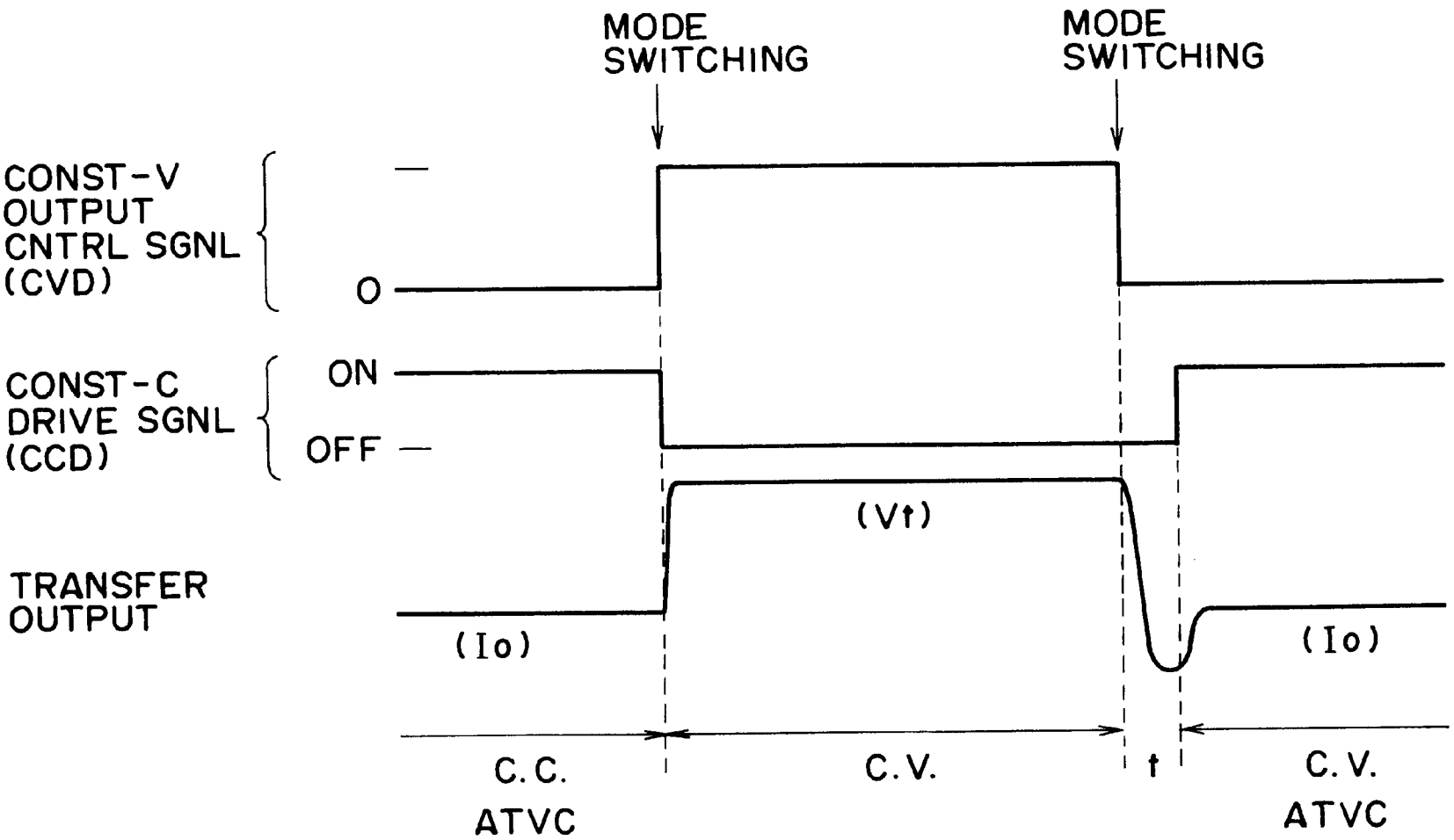
FIG. 7 is a timing chart for a method for driving a transfer voltage outputting conventional apparatus.

Embodiment 3 (FIG. 6)

In the first and second embodiments, the automatic transfer voltage control is executed during the "pre-rotation" as well as during the "sheet interval". In comparison, this embodiment is characterized in that the timing with which the automatic transfer voltage control is executed is changed in response to the printing modes of the image forming apparatus.

The control sequence in this embodiment will be described with reference to the flow chart in FIG. 6.

As the CPU 300 which controls the transfer voltage outputting apparatus 200 receives a print start command (Step S601), the timing with which the automatic transfer voltage control is executed is determined.

In determining the timing, the print mode is taken into consideration (Step S602). If the print mode is a "double sided print mode" in which an image is formed on both the front and back surfaces of a transfer sheet P, the ATVC timing is set so that the ATCC is executed during both the "pre-rotation" and the "sheet interval" (Step She).

If the print mode is not the "double sided print mode" (single sided print mode), the ATCC timing is set so that the ATVC is executed only during the "pre-rotation" (Step S604).

Then, printing is started (Step S605), and while this printing operation continues, the ATVC is executed with the above described timing.

At this time, the relationship between the print mode and the ATVC timing will be described.

When an image forming apparatus is in a double sided print mode to print an image on both surfaces of a recording sheet P, the recording sheet P is passed through the fixing apparatus 107 after a single cycle of the image forming operation is carried out to form an image on one of the surfaces of the recording sheet P, and then, the next cycle of image forming operation is carried out on the other side of the recording sheet P. Therefore, in the continuous print mode, the temperature of the transfer roller 105 increases due to the heat of the recording sheet P having been passed through the transfer station T. Thus, in the continuous print mode, in order to assure that a toner image is reliably and desirably transferred, the ATVC is executed during the "sheet interval" in addition to the "pre-rotation" to compensate for the heat induced changes in the properties of the transfer roller 105. It should be noted here that in this case, that is, in the double sided print mode, the sheet interval is set longer to execute the ATVC during the "sheet interval".

On the other hand, in the single sided print mode in which an image is printed on only one surface of a recording sheet P, the changes in the temperature of the transfer roller 105 do not become as large as in the continuous printing mode. Therefore, the ATVC is executed only during the pre-rotational period, and the sheet interval is reduced to increase the throughput of the apparatus.

When the above described control is executed, an image is reliably and desirably transferred without sacrificing the throughput of the image forming apparatus, at least in the single sided print mode in which the changes in the properties of the transfer roller 105 are small, even when the image forming apparatus is equipped with such a transfer voltage outputting apparatus that requires a relatively long time to switch from the constant current mode to the constant voltage mode.

Miscellaneous Embodiments

1. It is unnecessary to limit the choice of the image bearing member 101 to an electrophotographic photosensitive member; the image bearing member 101 may be constituted of an electrostatically recordable dielectric member, an electromagnetically recordable member, or the like. Further, the choice of the principle, on which the formation of a transferable image on the image bearing member is based, is optional.

The form of the image bearing member 101 is also optional; it is not limited to a drum, and may be a belt, a web, a sheet, or the like.

2. The form of the contact type transferring member 105 is optional; it does not need to be limited to a roller, and may be a belt, a combination of a belt and blade-shaped electrodes, or the like.

3. The recording medium P may be constituted of an intermediary transferring member in the form of an intermediary transfer drum or an intermediary transfer belt.

4. The ATVC does not need to be executed in all of the sheet intervals; it may be executed in every t-the sheet interval.

5. The constant current control of the transfer voltage outputting apparatus has only to be executed at least for a certain length of time during the period in which the image less portion of the peripheral surface of the image bearing member is in the transfer nip T.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a transfer member for transferring an image from said image bearing member onto a transfer material by a nip formed between said image bearing member and said transfer member;

control means for effecting a constant current control for said transfer member with a predetermined current when a non-image area of said image bearing member is at said nip, and for effecting a constant voltage control for the transfer member during image transfer operation on the basis of a voltage applied to said transfer member during said constant current control;

wherein a higher one of a constant voltage control signal for controlling the voltage in the constant voltage control and a constant current control signal for controlling the current in the constant current control, is selected as an output signal to said control means.

2. An apparatus according to claim 1, wherein the constant current control signal is on-state during the image transfer operation.

3. An apparatus according to claim 1, wherein said constant voltage control signal is on-state when the non-image area is at said nip.

4. An apparatus according to claim 1, wherein when the image transfer is continuously carried out, the constant current control is effected in a duration from passage of a leading edge of a transfer material to arrival of a leading edge of the next transfer material.

5. An apparatus according to claim 3, wherein when the non-image area of said image bearing member is at said nip, a level of said constant voltage control signal is lower than during image transfer onto the transfer material.

* * * * *

UNITED STATES PATENT AND TRADEMARK OFFICE

CERTIFICATE OF CORRECTION

PATENT NO. : 6,026,257

DATED : February 15, 2000

INVENTOR(S): HIROSHI TAKAMI, ET AL.

It is certified that error appears in the above-identified patent and that said Letters Patent is hereby corrected as shown below:

COLUMN 2:
Line 15, "ATCC" should read --ATVC--;
Line 17, "ATCC," should read --ATVC,--;
Line 24, "Veto" should read --Vto--;
Line 28, "Veto." should read --Vto.--;
Line 32, "$V_t$=axVeto+b[IV]." should read --$V_t$=axVto+b[kV].--;
and
Line 59, "Ea" should read --a--.

COLUMN 3:
Line 24, "ATCC" should read --ATVC--; and
Line 55, "ATCC" should read --ATVC--.

COLUMN 4:
Line 2, "ATCC" should read --ATVC--; and
Line 6, "The" should read --the--.

COLUMN 5:
Line 13, "medium," should read --media,--.

COLUMN 8:
Line 46, "Rd.," should read --R4,--; and
Line 58, "Ref" should read --Ref 1--.

UNITED STATES PATENT AND TRADEMARK OFFICE

CERTIFICATE OF CORRECTION

PATENT NO. : 6,026,257

DATED : February 15, 2000

INVENTOR(S) : HIROSHI TAKAMI, ET AL.

It is certified that error appears in the above-identified patent and that said Letters Patent is hereby corrected as shown below:

COLUMN 9:
Line 39, "The" should read --the--;
Line 45, "are" should read --is--; and
Line 52, "The" should read --the--.

COLUMN 10:
Line 9, "VEIN," should read --VSEN,--;
Line 11, "VEIN," should read --VSEN,--; and
Line 59, "that. Outputs" should read --that outputs--.

COLUMN 11:
Line 16, "a" should read --α--;
Line 53, "ATCC" should read ATVC--; and
Line 56, "(Step She)." should read --(Step S603).--.

Signed and Sealed this

Sixth Day of March, 2001

Nicholas P. Godici

*Attest:*

NICHOLAS P. GODICI

*Attesting Officer*

*Acting Director of the United States Patent and Trademark Office*